United States Patent [19]

Kikuta et al.

[11] Patent Number: 4,983,270

[45] Date of Patent: Jan. 8, 1991

[54] DEVICE FOR CONTROLLING THE AMOUNT OF A SOLID PAINT COMPONENT IN ELECTRODEPOSITION COATING

[75] Inventors: Makoto Kikuta; Hideo Terasawa, both of Hiratsuka, Japan

[73] Assignee: Kansai Paint Co., Ltd., Amagasaki, Japan

[21] Appl. No.: 145,028

[22] Filed: Jan. 19, 1988

[51] Int. Cl.[5] ..... C25D 13/22; C25D 13/24

[52] U.S. Cl. ..... 204/299 EC; 204/300 EC

[58] Field of Search ..... 204/299 EC, 300 EC

[56] References Cited

U.S. PATENT DOCUMENTS

| | | | |
|---|---|---|---|
| 3,616,459 | 10/1971 | Patton | 204/299 EC |
| 3,658,676 | 4/1972 | De Vittorio | 204/299 EC |
| 4,082,642 | 4/1978 | Hönig | 204/300 EC |
| 4,177,123 | 12/1979 | Siozawa | 204/299 EC |
| 4,192,728 | 3/1980 | Eromoto | 204/299 EC |
| 4,568,438 | 2/1986 | Lauke | 204/299 EC |

*Primary Examiner*—John F. Niebling
*Assistant Examiner*—Ben C. Hsing
*Attorney, Agent, or Firm*—Wenderoth, Lind & Ponack

[57] ABSTRACT

A device for controlling the amount of a solid component of a paint in electrodeposition coating includes a measuring tank, a temperature detecting section including a temperature sensor disposed in the measuring tank, a section for measuring the speed of propagation of ultrasonic waves including an ultrasonic wave generator and an ultrasonic wave receiver disposed within the measuring tank, an operation section connected to the temperature detecting section and the speed measuring section for producing a control signal according to the temperature of the paint in the measuring tank and the speed of propagation of ultrasonic waves, and a supply section connected to the operation section for supplying a replenishing paint to an electrodeposition coating tank according to the control signal.

4 Claims, 2 Drawing Sheets

V = SPEED OF PROPAGATION OF ULTRASONIC WAVES [m/sec]
T = TEMPERATURE [°C]

DEVICE FOR CONTROLLING THE AMOUNT OF A SOLID PAINT COMPONENT IN ELECTRODEPOSITION COATING

BACKGROUND OF THE INVENTION

1. Field of the Invention

This invention relates to a device for automatically controlling the amount of a solid paint component in an electrodeposition coating tank by utilizing ultrasonic waves.

2. Description of the Prior Art

Electrodeposition coating involves passing an electric current through an electrically conductive article immersed in a tank containing an electrodeposition paint whereby the solid component in the electrodeposition paint is deposited on the surface of the article and forms a coated film. The solid component of the electrodeposition paint is thus carried away by the article and the amount remaining in the paint in the tank tends to decrease gradually. To achieve the desired film thickness and properties, therefore, the amount of the solid component of the electrodeposition paint should be maintained at a certain fixed value.

In the prior art, the amount of the solid component of an electrodeposition paint is measured by a drying residue method consisting of the following steps:

(1) measuring the weight (A grams) of a weighing dish, (2) taking a paint sample into the weighing dish and measuring its weight (B grams), (3) placing the weighing dish containing the paint in a hot air oven, heating it, for example, at a temperature of 105° C. for 3 hours, evaporating water and the solvent, gradually cooling the sample in the hot air oven, taking out the sample when it attains room temperature, and measuring its weight (C grams), and (4) calculating the proportion of the solid component of the paint in accordance with $(C-A)/(B-A)$.

When the measured proportion of the solid component is lower than a fixed value beyond the tolerable range, the amount of a fresh replenishing paint of high solids content to be added is calculated from the balance between the measured proportion of the solid component and the desired fixed value proportion, and the fresh replenishing paint is sent to the electrodeposition coating tank by operating a pump.

The method of controlling the amount of the paint solid utilizing the drying residue method thus goes through steps of sampling, weighing, heating, gradual cooling and calculation, and requires a great deal of expense, time and labor. Furthermore, since this method does not permit real-time measurement, the amount of the solid paint component is liable to vary.

Another known method is to count the number of coated articles which have passed through the electrodeposition coating tank by a counter, and presuming the change of the amount of the solid component from (the amount of the paint coated per article)×(the number of the coated articles). The change of the proportion of the solid component presumed by this method, however, has low reliability when the shapes and areas of the coated articles are not constant.

SUMMARY OF THE INVENTION

In accordance with this invention, the above problems are solved by providing a device for controlling a solid component of a paint in electrodeposition coating, said device comprising a measuring tank, a temperature detecting section including a temperature sensor disposed in the measuring tank, a section for measuring the speed of propagation of ultrasonic waves including an ultrasonic wave generator and an ultrasonic wave receiver disposed within the measuring tank, an operation section connected to the temperature detecting section and the speed measuring section for producing a control signal according to the temperature of the paint in the measuring tank and the speed of propagation of ultrasonic waves, and a supply section connected to the operation section for supplying a replenishing paint to an electrodeposition coating tank according to the control signal.

DESCRIPTION OF THE PREFERRED EMBODIMENTS

Figure 1:
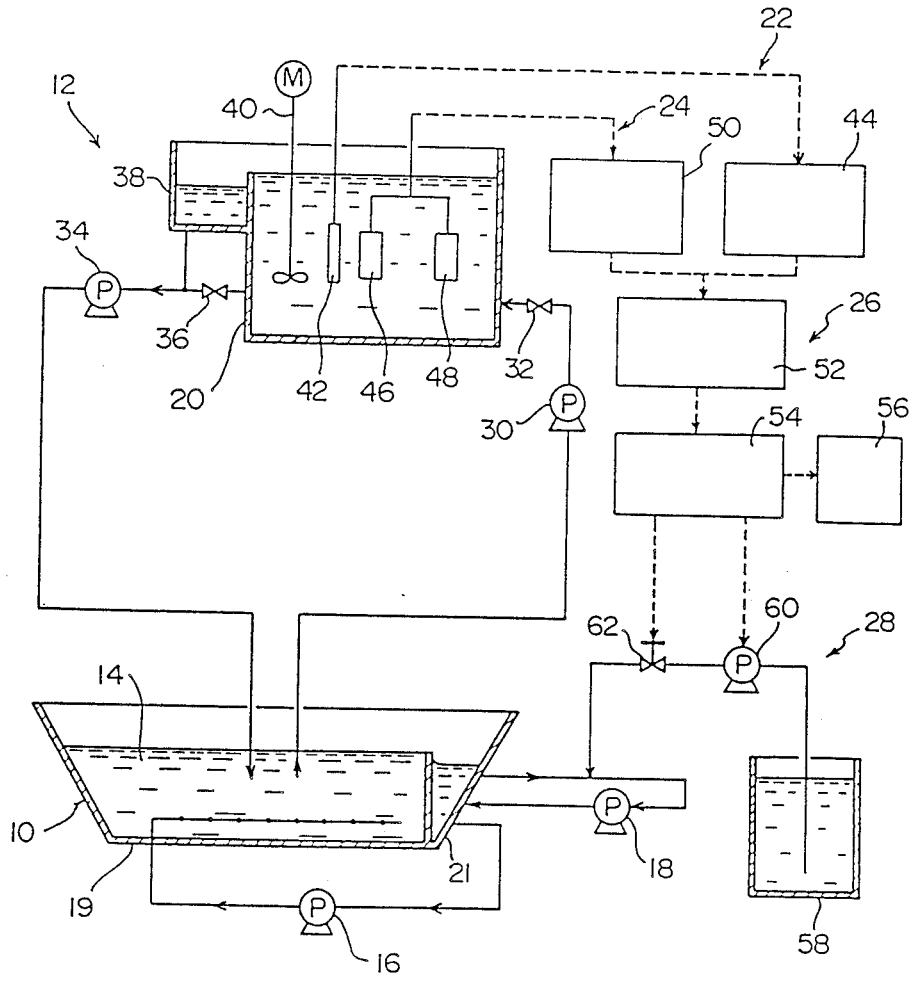
FIG. 1 is a simplified view of an electrodeposition coating tank and a device for controlling the amount of a solid paint component in an electrodeposition coating in accordance with a preferred embodiment of this invention.
Figure 2:
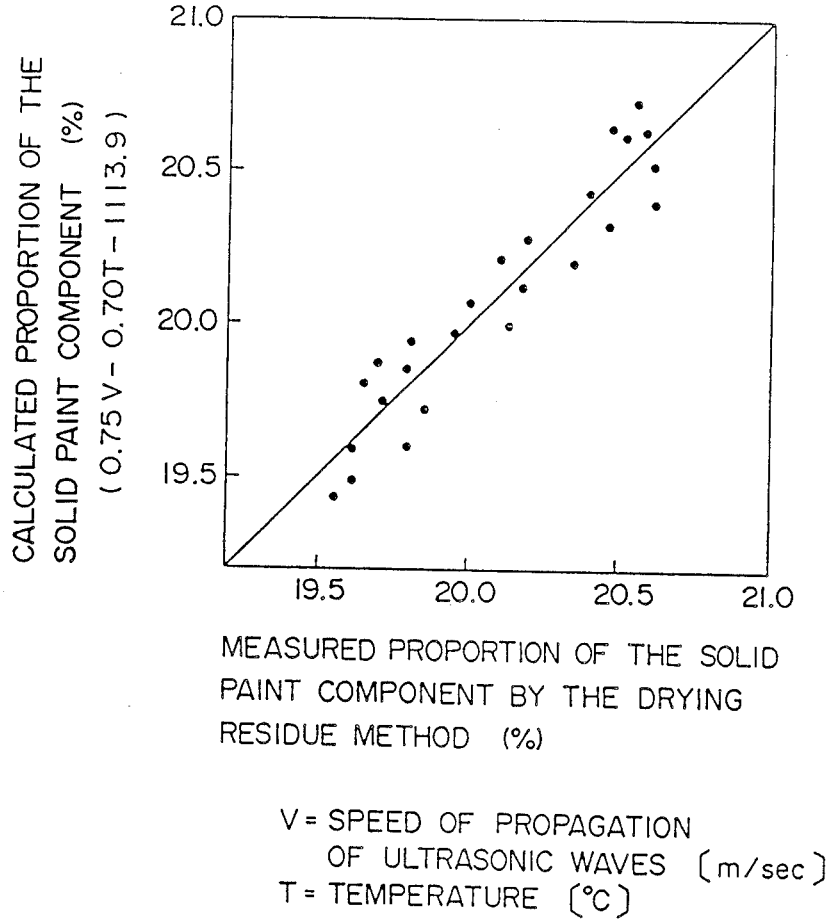
FIG. 2 is a diagram showing the relation between the proportion of a solid paint component measured by the drying residue method and the proportion of the solid paint component calculated by the device of this invention.

With reference to FIGS. 1 and 2, the control device in accordance with the preferred embodiments of the invention will be described.

FIG. 1 shows an electrodeposition coating tank 10 for performing electrodeposition coating and a control device 12 for controlling the amount of a solid component of a paint in the electrodeposition coating tank.

An electrodeposition paint 14 in the tank 10 is circulated by a first circulating pump 16 and a second circulating pump 18 to prevent sedimentation.

The electrodeposition coating tank 10 includes a main coating tank 19 and an auxiliary coating tank 21, and the paint overflowing from the main tank 19 flows into the auxiliary tank 21. The first circulating pump 16 sends the paint from the auxiliary tank 21 to the lower part of the main tank 19. Consequently, the paint circulatingly flows through the auxiliary tank 21, the first circulating pump 16, the lower part of the main tank 19 and the upper part of the main tank 19 and returns to the auxiliary tank 21.

The second circulating pump 18 draws and returns the paint from and to the auxiliary tank 21 as shown in FIG. 1. In this embodiment, a replenishing paint is supplied to the auxiliary tank 21 by the second circulating pump 18.

The control device 12 in accordance with a preferred embodiment of the invention comprises a measuring tank 20, a temperature detecting section 22, a section 24 for measuring the speed of propagation of ultrasonic waves, an operation section and a supply section 28 for supplying a replenishing paint to the electrodeposition coating tank 10.

The electrodeposition paint is continuously fed from the electrodeposition coating tank 10 to the measuring tank 20 by means of a paint supply pump 30 via a valve 32, and returned to the electrodeposition coating tank 10 by a discharge pump 34 via a valve 36. The liquid level of the measuring tank 20 is maintained constant by adjusting the degree of opening of the valves 32 and 36.

Preferably, as shown in FIG. 1, an auxiliary tank 38 is provided adjacent to the measuring tank 20 so as to return the excess of the electrodeposition paint to the electrodeposition coating tank 10 by the discharge pump 34.

An agitator 40 is disposed within the measuring tank 20 to prevent sedimentation of the paint in the measuring tank 20.

The temperature detecting section 22 comprises a temperature sensor 42 immersed in the paint in the measuring tank 20 and a temperature measuring member 44 connected to it. An electrical signal showing the temperature of the paint in the measuring tank 20 is outputted from the temperature measuring member 44.

A speed detecting section 24 for detecting the speed of propagation of ultrasonic waves includes an ultrasonic wave generator 46 and an ultrasonic wave receiver 48 arranged spaced from each other a predetermined distance within the electrodeposition paint in the measuring tank 20, and a speed measuring member 50 connected to them for measuring the speed of propagation of ultrasonic waves. An electrical signal showing the speed of propagation of ultrasonic waves in the electrodeposition paint in the measuring tank 20 is outputted from the speed measuring member 50.

An operation section 26 includes an operation circuit 52, an output circuit 54 and a recorder 56. The operation section 26 is connected to the temperature measuring member 44 and the speed measuring member 50 and includes an electronic element for memorizing function $W=F(V,T)$ expressing the proportion W of the solid paint component as a function of the speed V of propagation of ultrasonic waves and the temperature T and calculating the proportion W of the solid paint component from the propagation speed V and the temperature T.

The function $W=F(V,T)$ is preset by varying the proportion W of the solid paint component and the temperature T and measuring the speed of propagation of ultrasonic waves at varying values of W and T.

FIG. 2 shows the proportion of a solid paint component (Elecron #9450, a cationic electrodeposition paint produced by Kansai Paint Co.) calculated from the function $W=F(V,T)$ and the proportion of this solid paint component measured by the drying residue method. They show a very good agreement. This demonstrates that values calculated from the function $W=F(V,T)$ are very reliable.

A signal expressing the result of the operation is fed into the output circuit 54 from the operation circuit 52. Preferably, as shown in the drawings, the recorder 56 is connected to the output circuit 54 to record the proportion of the solid paint component which varies with time.

The supply section 28 is connected to the output circuit 54 to control the supply of a replenishing paint to the electrodeposition coating tank 10.

The supply section 28 includes a replenishing paint tank 58, a replenishing paint supply pump 60 and an electromagnetic valve 62. The supply pump 60 and the electromagnetic valve 62 are connected to the output circuit 54. An actuation signal from the output circuit 54 actuates the replenishing paint supply pump 60 to open the electromagnetic valve 62. As a result, the replenishing paint is sent to a circulating flow passage including the second circulating pump 18 from the replenishing paint tank 58 via the pump 60 and the electromagnetic valve 62, as shown in the drawing.

The control device operates in the following manner.

On the basis of the temperature T measured by the temperature detecting section 22, the speed V of propagation of ultrasonic waves measured by the speed measuring section 24, and the function $W=F(V,T)$ memorized in the operation circuit 52, the operation circuit 52 calculates the proportion W of the solid paint component.

The proportion of the solid component of the paint in the electrodeposition coating tank 10 which is supplied to the measuring tank 20 is compared with a preset value in the output circuit 54. If it is smaller than the lower limit $W_1$ of the preset proportion of the solid paint component, an actuation signal from the output circuit 54 actuates the replenishing paint supply pump 60 and opens the electromagnetic valve 62. Consequently, the replenishing paint is supplied from the replenishing paint tank 58 to the main tank 19 of the electrodeposition coating tank 10 via the supply pump 60, the electromagnetic valve 62, the second circulating pump 18 and the first circulating pump 16. Since the proportion of the solid component in the replenishing paint is higher than that in the paint placed in the electrodeposition coating tank 10, the proportion of the solid component of the paint in the tank 10 gradually increases.

The paint in the electrodeposition coating tank 10 is always circulated through the paint supply pump 30, the measuring tank 20 and the discharge pump 34, and the proportion of the solid component is measured continuously in the measuring tank 20.

When the proportion W of the solid component in the measuring tank 20 is compared with the preset value in the output circuit 54 and found to be higher than the upper limit $W_2$ of the preset value, a stop signal from the output circuit 54 stops the replenishing paint supply pump 60 and closes the electromagnetic valve. Consequently, the supply of the replenishing paint from the tank 58 to the tank 10 is stopped.

In the above embodiment, the temperature sensor 42, the ultrasonic wave generator 46 and the ultrasonic wave receiver 48 are provided within the measuring tank 20 set up separately from the electrodeposition coating tank 10. If desired, these devices 42, 46 and 48 may alternatively be provided within the electrodeposition coating tank 10 or in the flow passage including the first circulating pump 16.

The control device in accordance with this invention enables the amount of the solid paint component within the electrodeposition coating tank to be automatically maintained at a suitable value.

What is claimed is:

1. A device for controlling the amount of a solid component of a paint in electrodeposition coating, said device comprising a measuring tank means, a temperature detecting section including a temperature sensor disposed in the measuring tank means, a section for measuring the speed of propagation of ultrasonic waves including an ultrasonic wave generator and an ultrasonic wave receiver disposed within the measuring tank means, an operation section connected to the temperature detecting section and the speed measuring section for producing a control signal according to the temperature of the paint in the measuring tank means and the speed of propagation of ultrasonic waves, and a supply section connected to the operation section for supplying a replenishing paint to an electrodeposition coating tank according to the control signal.

2. The control device of claim 1 wherein the measuring tank means is a measuring tank provided separately from the electrodeposition coating tank.

3. The control device of claim 1 wherein the measuring tank means is part of an electrodeposition coating tank.

4. The control device of claim 1 wherein the temperature sensor, the ultrasonic wave generator and the ultrasonic wave receiver are disposed within a circulation flow passage in the electrodeposition coating tank, said circulation flow passage constituting the measuring tank means.

* * * * *